US005450839A

United States Patent [19]

Nicolaevich et al.

[11] Patent Number: 5,450,839

[45] Date of Patent: Sep. 19, 1995

[54] PNEUMATIC LAUNCHER

[76] Inventors: Isakov S. Nicolaevich, Severny pr., d.83, kv. 154, St. Petersburg, U.S.S.R., 195249; Isakov I. Nicolaevich, pos. Levasheva, d.35, St. Petersburg, U.S.S.R., 194901; Yurkin S. Vasilievich, Prosveshenia pr., d. 35, kv. 340, St. Petersburg, U.S.S.R., 194245

[21] Appl. No.: 124,827

[22] Filed: Sep. 21, 1993

[30] Foreign Application Priority Data

Sep. 23, 1992 [SU] U.S.S.R. ..... 5066580

[51] Int. Cl.[6] ..... F41B 11/06

[52] U.S. Cl. ..... 124/73; 124/75; 124/70

[58] Field of Search ..... 124/73, 75, 74, 70, 124/71, 56–57, 60–61, 69, 76–77, 63, 64

[56] References Cited

U.S. PATENT DOCUMENTS

| | | | |
|---|---|---|---|
| 399,882 | 3/1889 | Graydon . | |
| 1,399,243 | 12/1921 | Bergman . | |
| 1,483,129 | 2/1924 | Stockett . | |
| 2,413,703 | 1/1947 | Fischer . | |
| 2,581,758 | 1/1952 | Galliano et al. | 124/75 |
| 2,660,993 | 12/1953 | Blakeslee . | |
| 3,131,646 | 5/1964 | Parrott | 124/73 X |
| 3,583,087 | 6/1971 | Huebner . | |
| 3,726,266 | 4/1973 | Palmer . | |
| 3,802,407 | 4/1974 | Imazu . | |
| 4,004,566 | 1/1977 | Fischer . | |
| 4,077,349 | 3/1978 | Paul . | |
| 4,159,705 | 7/1979 | Jacoby | 124/75 X |
| 4,332,234 | 6/1982 | Allen . | |
| 4,572,152 | 2/1986 | Olofsson et al. | 124/69 |
| 4,799,906 | 1/1989 | Perkins, Jr. . | |
| 4,890,597 | 1/1990 | Ekstrom . | |
| 4,936,282 | 6/1990 | Dobbins et al. | 124/74 |
| 4,951,644 | 8/1990 | Bon . | |
| 5,086,749 | 2/1992 | Ekstrom . | |

FOREIGN PATENT DOCUMENTS

| | | | |
|---|---|---|---|
| 440428 | 8/1991 | European Pat. Off. | 124/56 |
| 2479128 | 3/1981 | France . | |
| 3111044 | 3/1981 | Germany . | |
| 253270 | 11/1990 | U.S.S.R. . | |
| WO821860 | 10/1986 | WIPO . | |

*Primary Examiner*—Randolph A. Reese
*Assistant Examiner*—Harry C. Kim
*Attorney, Agent, or Firm*—Limbach & Limbach

[57] ABSTRACT

There is disclosed a pneumatic launcher comprising a cylindrical storage member and a cylindrical barrel which are coaxial, and a cylindrical body therebetween. Pressurized gas is coupled into the chamber of the body. A valve member has a sleeve portion which telescopingly receives the cylindrical body. The gas entering the chamber leaks through the space between the sleeve portion and the body to fill the reservoir. The valve member has a second valve portion which is conical and movable against a valve seat. When it is desired to launch a projectile in the barrel, gas is exhausted from the chamber causing the valve member to snap back to its opened condition almost instantaneously to deliver gas from the reservoir to the barrel, thereby to launch the projectile therein.

7 Claims, 3 Drawing Sheets

PNEUMATIC LAUNCHER

BACKGROUND OF THE INVENTION

Certain currently available launchers utilize a powder charge for launching a projectile which may be to secure forced entry or which may carry fire extinguishing chemicals or other chemicals or objects or a line. Such devices are dangerous to use because they are prone to cause explosions and fires. Also, the shot is expensive and the storage life short. Another kind of known launcher includes a movable element that strikes the projectile, undesirably resulting in high impacts and necessitating that the device be capable of withstanding high loads. Pneumatic launchers are known, but they are complicated and inefficient in use of the compressed air. One known pneumatic launcher is opened to deliver pressurized gas into the barrel. It includes a main valve which is relatively slow to open; the opening time approaches or even exceeds the time that the projectile is in the barrel. This is undesirable because it is not very efficient and the exit velocities of projectile are not as high as desired.

SUMMARY OF THE INVENTION

It is an important object of the present invention to provide an improved pneumatic launcher.

Another object is to provide a pneumatic launcher that makes more efficient use of the compressed gas.

Another object is to reduce the mass and size of a pneumatic launcher.

Another object is to insure that the time for accelerating the projectile in the barrel is many times greater than the time required to open the main valve.

In summary there is provided a pneumatic launcher comprising a storage member having a reservoir therein, a body having a chamber therein, a barrel having a bore therethrough through which a projectile can be launched, the chamber having an inlet thereto and an outlet therefrom, means for coupling the inlet to a source of pressurized gas, a first valve mechanism between said reservoir and the chamber and having a condition to allow passage of pressurized gas from the source and through the chamber and into the reservoir, a second valve mechanism between the reservoir and the barrel and being responsive to reduction and increase of the pressure of the gas in the chamber to be placed respectively in its opened and closed conditions, and a control valve coupled to the outlet and having an opened condition to reduce the pressure in the chamber to cause the second valve mechanism to open and thereby greatly increase the pressure in the barrel to launch the projectile therein.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENT

Figure 1:
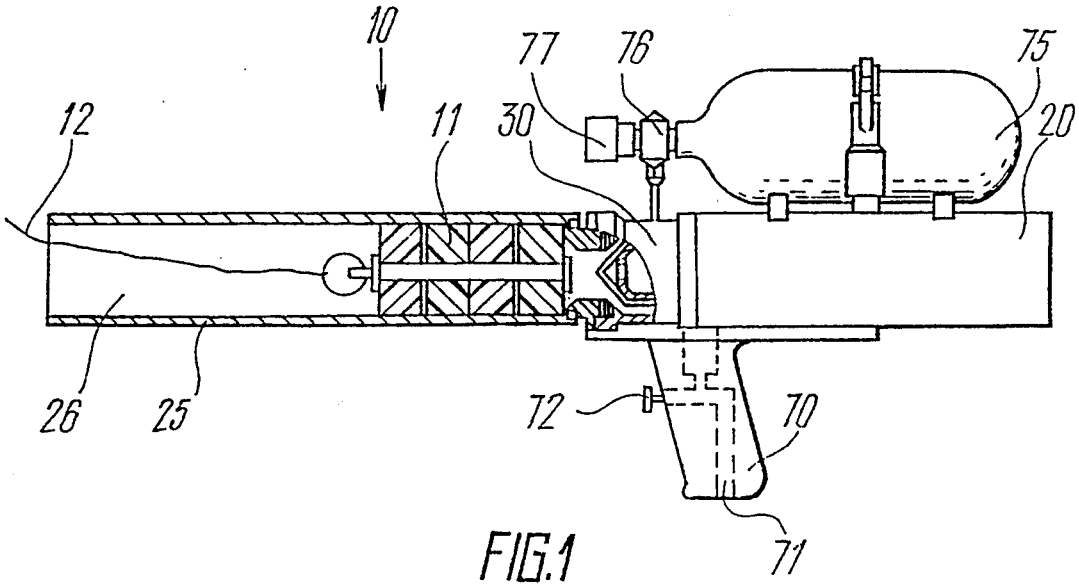
FIG. 1 is an elevational view of a pneumatic launcher constructed in accordance with the features of the present invention, the barrel and a portion of the central housing being shown in section to expose their interiors.

Referring now to the drawings and more particularly to FIG. 1 thereof, there is depicted a pneumatic launcher 10 incorporating the features of the present invention. Launcher 10 is adapted to launch a projectile 11, which may be to secure forced entry, or which may carry fire extinguishing chemicals, or other chemicals or objects. In one use of launcher 10, projectile 11 includes a line 12. Projectile 11 is launched, for example, toward a drowning person to send a life line to him.

Launcher 10 comprises a cylindrical storage member 20 defining a cylindrical reservoir 21 therein. Launcher 10 also comprises a cylindrical barrel 25 having a bore 26 therethrough. Barrel 25 has an end wall 27. Storage member 20 and barrel 25 are preferably coaxial. In an actual form of the invention, bore 26 had a diameter 90% of that of reservoir 21 and the volumes of reservoir 21 and barrel 25 were about equal.

Launcher 10 further comprises a generally cylindrical housing 30 located between member 20 and barrel 25 and including a rear portion 31 and a front portion 32 attached together. The front of front portion 32 is of reduced diameter and defines a threaded neck 33 that is threaded into end wall 27. The rear of front portion 32 provides a shoulder 34. Rear portion 31 has an inwardly projecting lip 35.

Launcher 10 further comprises a valve seat 40, which in the embodiment shown, includes a pair of spaced-apart metal washers 41 and 42 and a pair of spaced-apart rubber washers 43 and 44. Metal washers 41, 42 alternate with rubber washers 43, 44 to define a stack located between radial surfaces of shoulder 34 and lip 35. Relatively thin rubber washers 43 and 44, as depicted, are preferable to the use of a single thicker washer. The washers respectively have inwardly facing frustoconical surfaces 41*a*, 42*a*, 43*a*, 44*a*. Surfaces 43*a* and 44*a* project inwardly beyond surfaces 41*a* and 42*a*.

Launcher 10 further comprises a body 50 located within housing 30 and having a chamber 51 therein. Body 50 includes a generally cylindrical wall 52 at the rear and a frustoconical wall 53 at the front, terminating in a radially extending end wall 54. End wall 54 has an opening 55. Extending radially through body 50 are an inlet 56 and an outlet 57. Extending axially through body 50 are three arcuate passageways 58.

Figure 2:
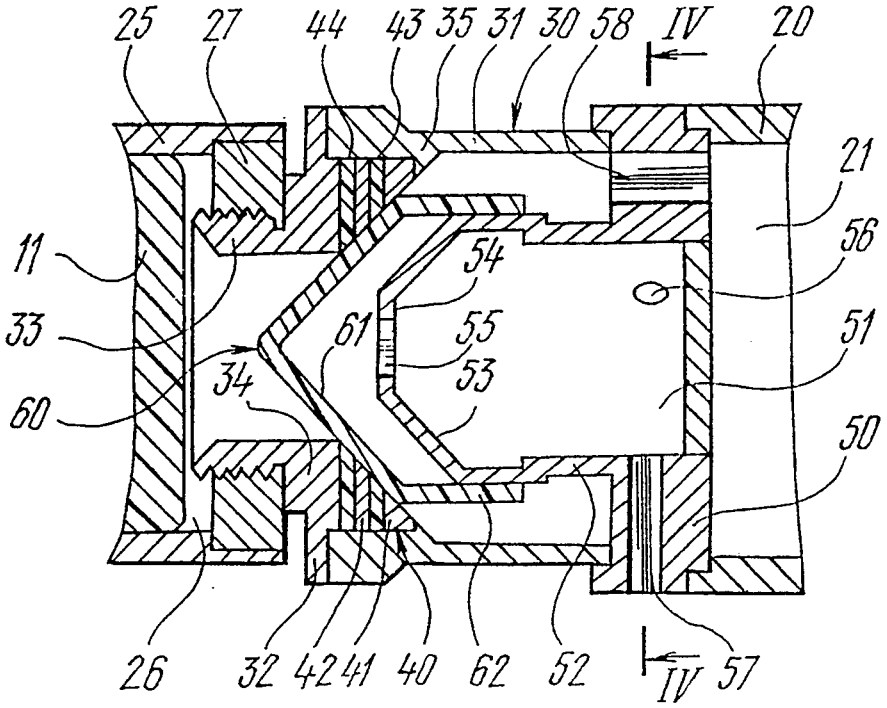
FIG. 2 is an enlarged view in section of the housing and adjacent portions of the barrel and the storage member, the valve being in the closed position thereof.

Launcher 10 further comprises a valve member 60 including a conical valve portion 61 and a cylindrical valve portion 62. Valve member 60 is preferably composed of one piece of elastic material such as phenolic. Valve member 60 is telescopically positioned on body 50. The inner diameter of valve portion 62 approximately equals the outer diameter of cylindrical wall 52, so as to provide semi-sealing engagement therebetween. Valve member 60 is movable between an opened position depicted in FIGS. 1 and 3, spaced from valve seat 40 and a closed position depicted in FIG. 2 in sealingly engagement with valve seat 40.

Attached to barrel 25 is a handle 70 which includes a passageway 71 that communicates with outlet 57. Handle 70 carries a trigger 72 which functions as a valve. Trigger 72 is normally in the closed position thereof. When trigger 72 is actuated, passageway 71 is opened to exhaust gas from chamber 51 through outlet 57. Inlet 56 is connected to a source 75 of pressurized gas via a pressure reducer 76 and a valve 77. In an actual embodiment, the pressure of the gas into inlet 56 was between 50 and 300 psi.

Figure 3:
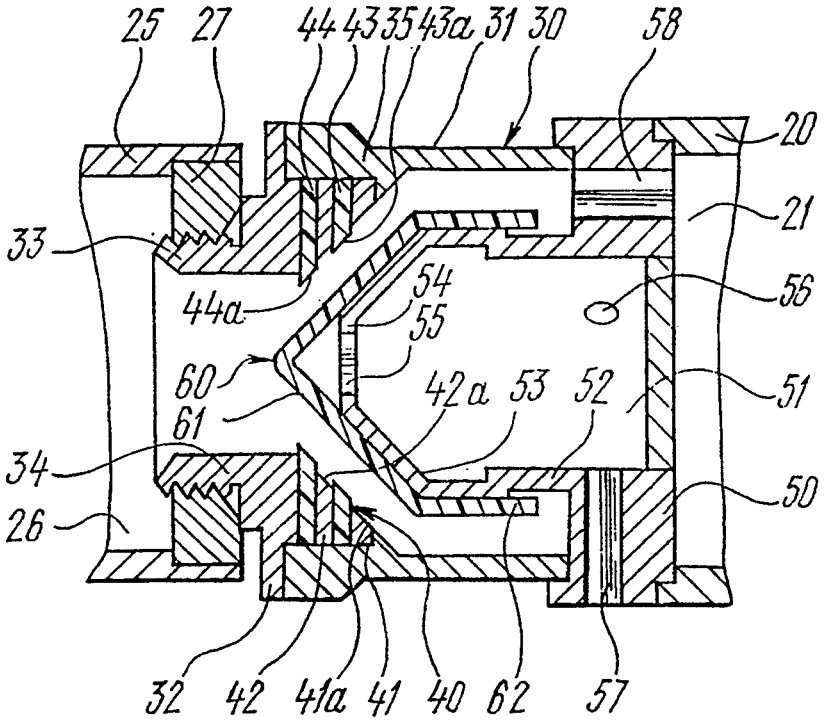
FIG. 3 is a view like FIG. 2, but with the valve member in the opened position thereof.
Figure 4:
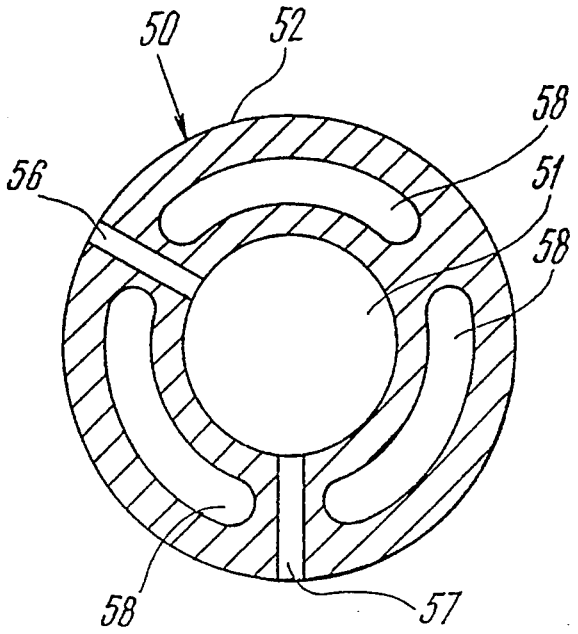
FIG. 4 is a view in cross section taken along the line 4—4 of FIG. 2.
Figure 5:
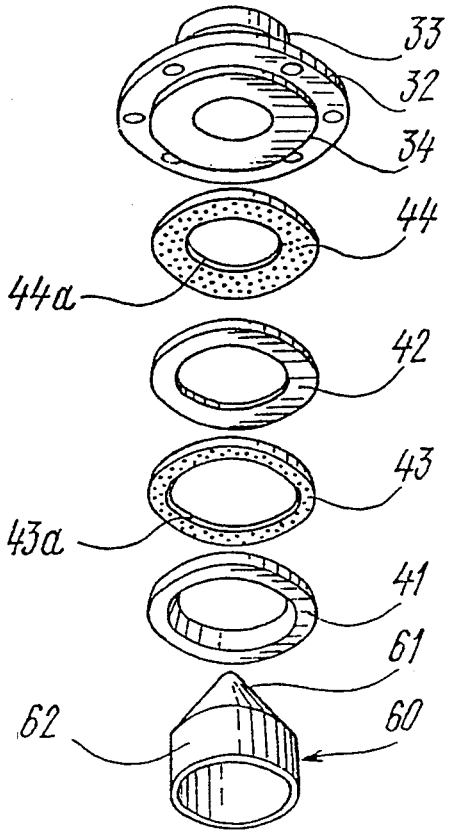
FIG. 5 is an exploded view of the main valve.

To use launcher 10, valve 77 is opened to allow pressurized gas to enter inlet 56 into chamber 51. Initially, the main valve, consisting of valve member 60 and valve seat 40, is open as depicted in FIGS. 1 and 3. The gas passes through opening 55, forcing valve member 60 forwardly so that valve portion 61 is forced against valve seat 40 and specifically against surfaces 43*a* and 44*a* of rubber washers 43 and 44. Washers 43 and 44 are slightly deformed to provide a good seal. Thus, valve portion 61 and valve seat 40 constitute one valve mechanism. The portion between cylindrical wall 52 of body 50 and valve portion 62 of valve member 60 constitute a second valve mechanism.

The pressurized gas in chamber 51 passes through opening 55 and leaks through the second valve mechanism, that is, between wall 52 and valve portion 62, flowing through passageways 58 into reservoir 21. When reservoir 21 is filled, valve 77 is turned off. Launcher 10 is now ready to launch a projectile. To do so, the user depresses trigger 72 causing the pressure in chamber 51 to drop as well as the pressure between frustoconical wall 53 and valve portion 62. The greater pressure in front of valve portion 61 causes valve member 60 to snap rearwardly, thereby opening the valve mechanism defined by valve portion 61 and valve seat 40. The gas stored in reservoir 21 very quickly passes through passageways 58 around valve member 60 and into bore 26. Projectile 11 is thus launched through bore 26. To prepare for the next launch, valve 77 is opened to fill a reservoir 21 again.

An important aspect of the present invention is the fact that valve member 60 opens virtually instantaneously, preferably in less than 0.001 second, whereas, the period of accelerating the projectile 11 in barrel 25 is more than 0.01 second.

What has been described, therefore, is an improved pneumatic launcher which is relatively simple in construction and is highly efficient. While a preferred embodiment of the invention is described, it is understood that the invention is not defined thereby, but, instead, by the following claims.

What is claimed is:

1. A pneumatic launcher comprising a storage member having a reservoir therein, a barrel having a bore therethrough through which a projectile can be launched, a body having a chamber therein, said chamber having an inlet thereto and an outlet therefrom, means for coupling said inlet to a source of pressurized gas, a main valve between said reservoir and said bore of the barrel, said main valve being responsive to the pressure of the gas in said chamber, and adapted to be movable between opened and closed conditions, said main valve including a valve seat having at least one deformable annular flange, and a valve member having first and second valve portions, said first valve portion being a cylindrically shaped part telescopically receiving said body, said second valve portion being cone shaped, said first valve portion and said body being constructed and arranged to allow passage of the pressurized gas from the source and through said chamber and into said reservoir, said second valve portion being responsive to the reduction and increase of the pressure of the gas in said chamber respectively to separate from said seat and to sealingly engage said seat, and a control valve coupled to said outlet and having an opened condition to reduce the pressure in said chamber to cause said second valve portion to move away from said valve seat, thereby greatly increasing the pressure in said barrel to launch the projectile therein.

2. The pneumatic launcher of claim 1, wherein said valve member is composed of elastic material.

3. The pneumatic launcher of claim 1, wherein said valve seat includes two spaced deformable annular flanges, said deformable flanges being engaged by said second valve portion in the sealing position thereof.

4. The pneumatic launcher of claim 3, wherein said valve seat includes a pair of rubber washers with a metal washer therebetween, said rubber washers forming said spaced deformable annular flanges, said washers having inwardly facing frustoconical surfaces, said surfaces of the rubber washers projecting inwardly beyond said surface of the metal washer.

5. The pneumatic launcher of claim 1, wherein said body has a frustoconical portion, contacting said second valve portion with the main valve in said opened condition.

6. The pneumatic launcher of claim 1, wherein said body has an opening in a frustoconical portion to enable passage of the pressurized gas towards said second valve portion and between said first valve portion and said body.

7. The pneumatic launcher of claim 1, wherein said body has a plurality of channels coupling said reservoir to said bore of the barrel.

* * * * *